US007361225B2

(12) United States Patent
Yamamoto

(10) Patent No.: US 7,361,225 B2
(45) Date of Patent: Apr. 22, 2008

(54) LIQUID TANK

(75) Inventor: Wataru Yamamoto, Tokyo (JP)

(73) Assignee: Yamamoto-MS Co., Ltd., Tokyo (JP)

( * ) Notice: Subject to any disclaimer, the term of this patent is extended or adjusted under 35 U.S.C. 154(b) by 120 days.

(21) Appl. No.: 10/847,611

(22) Filed: May 18, 2004

(65) Prior Publication Data

US 2004/0245106 A1 Dec. 9, 2004

(30) Foreign Application Priority Data

Jun. 6, 2003 (JP) ..... 2003-161657

(51) Int. Cl.
*B05C 3/00* (2006.01)

(52) U.S. Cl. ..... 118/429; 118/612

(58) Field of Classification Search ..... 118/610–612, 118/429; 204/237, 275.1, 276; 366/273, 366/274; 435/295.1, 297.2
See application file for complete search history.

(56) References Cited

U.S. PATENT DOCUMENTS 2,554,803 A * 5/1951 Wysocki ..... 118/610
3,496,082 A * 2/1970 Orem et al. ..... 204/482
3,638,799 A * 2/1972 Serowiecki ..... 210/462
4,337,720 A * 7/1982 Hager ..... 118/50
4,665,736 A * 5/1987 Yokoyama et al. ..... 73/23.2
4,805,553 A * 2/1989 Krulik ..... 118/603

FOREIGN PATENT DOCUMENTS

| | | |
|---|---|---|
| DE | 297 01 888 | 3/1997 |
| EP | 0 460 645 | 12/1991 |
| EP | 1 229 154 | 8/2002 |
| JP | 07-268638 | 10/1995 |

OTHER PUBLICATIONS

European Search Report for EP Application 04011821.8, dated Dec. 29, 2006.

* cited by examiner

*Primary Examiner*—Brenda A. Lamb
(74) *Attorney, Agent, or Firm*—Squire, Sanders & Dempsey L.L.P.

(57) ABSTRACT

The present invention provides a liquid tank which has a compact construction comprising a process bath, an agitation service bath, an agitation room, a liquid supply tunnel, and a liquid supply outlet.

17 Claims, 12 Drawing Sheets

LIQUID TANK

FIELD OF THE INVENTION

The present invention relates to the construction of a liquid tank, especially to wet plating tank that is used to keep the electrolytic or electroless solution for the process of wet plating.

BACKGROUND OF THE INVENTION

For the purpose of homogeneity in the density and temperature distribution of the liquid for wet plating, one of the conventional technologies is to use a rotator 32 put on the bottom of a beaker which is filled with plating liquid L wherein the rotator 32 is driven by the stirrer station 30 on which the beaker is put. By this agitation system, the density and the temperature distribution is kept homogenous in the whole volume of the plating liquid L.

In the conventional technologies, a circulator 41 (comprising an electrical pump 42 and the filter 43) and a filter 43 are externally attached to remove the deposit such as educts, compound colloids and foreign dusts staying in the plating liquid L. The concrete installation is that the electrical pump 42 pumps the plating liquid L up to the filter 43 and the plating solution is filtrated by the filter 43 and returned back to the plating tank 40. A plating apparatus including such a filtration apparatus is described in the reference 1.

Reference 1

Japanese Published Patent, 07-268638, A (1995)

BRIEF SUMMARY OF THE INVENTION

There are problems in the conventional technology, in which rotational flow is generated in the plating liquid L when the stirrer station 30 drives the rotator 32. Once such rotational flow is generated, it takes time before the plating liquid L becomes homogenous in the solution density and the temperature distribution.

Another problem is that the rotational flow in the plating liquid L generates stripe patterns on the plated surface of the plated material. Then no homogenously plated surface is obtained. Since the plating liquid L is always stirred by the rotator 32, the level of the plating liquid L is not stable. Therefore it is not possible to plate on a strict portion of the material by partly immersing the material in the plating liquid L.

The other problem may be seen in FIG. 12. The conventional plating apparatus has a circulator 41 externally set for circulating the plating liquid L. Therefore the plating apparatus becomes large as a whole. In this circulation system, the plating liquid L stays in the circulator 41 (as an electrical pump 42 and a filter 43) and therefore additional "dead plating liquid" is necessary.

The present invention is provided to solve these issues by construction of two bathes as a plating bath to perform plating process and an agitation service bath to which the plating liquid overflows from the plating bath. Further construction is that the agitator is put in the agitation room and the plating liquid is sent from the agitation service bath to the plating bath through the liquid supply tunnel.

The present invention has an advantage that no rotational flow is generated in the plating liquid while the plating liquid is agitated to keep the homogenous density of the solution of the plating liquid and the homogenous temperature distribution in the tank. The present invention has further advantage that no additional external pump circulator is necessary for performing the plating, which allows an easy operation and maintenance services.

The plating tank according to the present invention includes a plating bath to perform plating process and an agitation service bath to which the plating liquid overflows from the plating bath, of which both bathes are connected through an agitation room and a liquid supply tunnel. An agitator is put in the agitation room and the plating liquid is sent from the agitation service bath to the plating bath through the liquid supply tunnel when the agitator works.

DETAILED DESCRIPTION OF THE INVENTION

Figure 1:
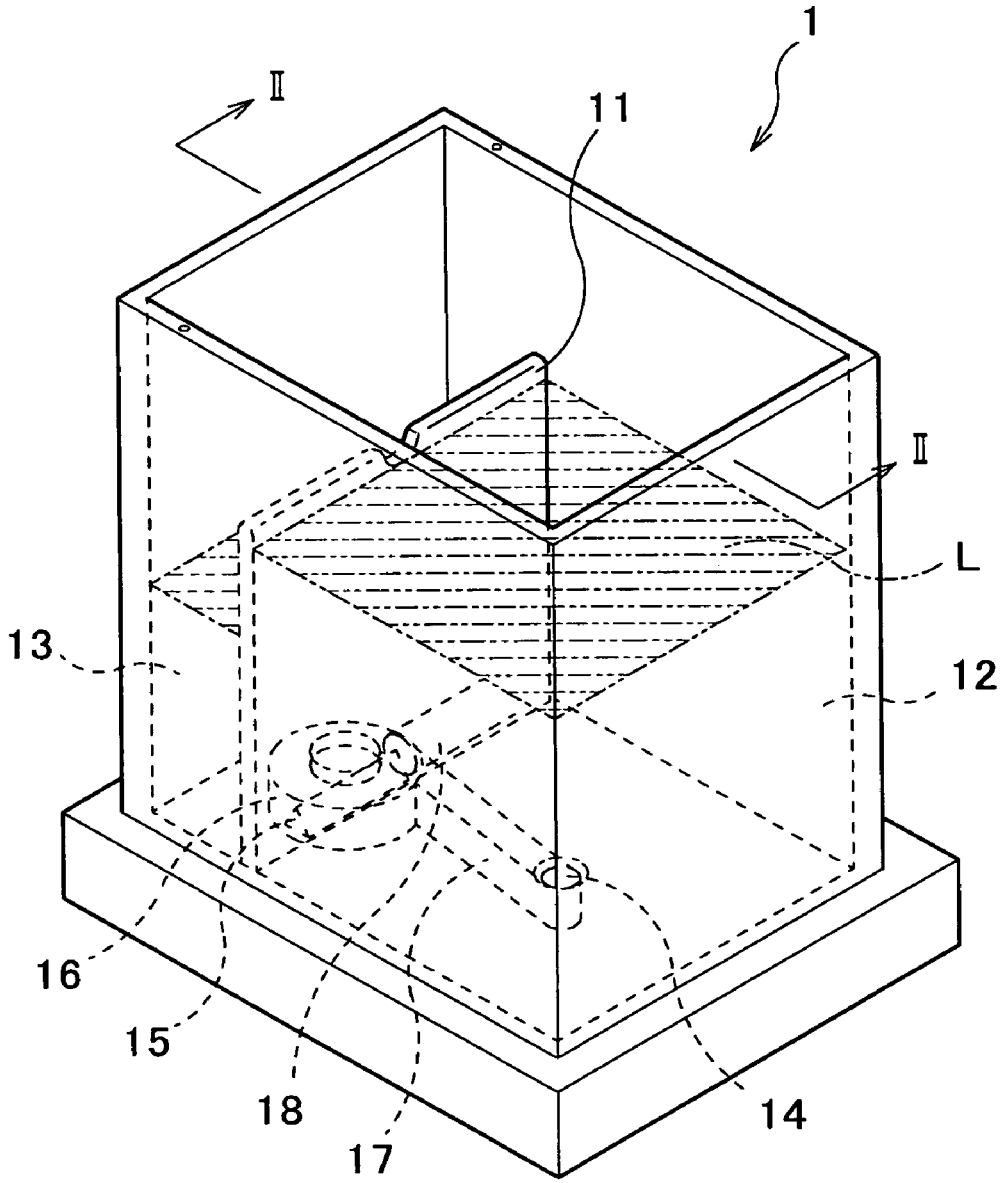
FIG. 1 is a perspective drawing of the plating tank of the present invention.

In this configuration of a plating tank as shown in FIG. 1, the liquid supply to the plating bath 12 is carried out by sending plating liquid L through liquid supply tunnel 17 after agitating the plating liquid L at the agitation room 16. No agitation is generated in the plating bath 12 and therefore no rotational flow is generated therein. The agitation at the agitation room 16 generates pushing force to the liquid flow and the liquid circulation is carried out without using an external additional circulator.

The embodiments of the present invention will be explained in details by using the figures.

The construction of the plating tank 1 will be explained using FIG. 1 to FIG. 2. The plating bath 12 is filled with the plating liquid L in FIG. 1 and FIG. 2.

FIG. 1 shows a perspective view of the plating tank regarding the present invention. FIG. 2 shows the cross sectional view of the plating tank cut in the line II and II.

The plating tank 1 has a partition plate 11 which has a predetermined height by which the inside of the tank is partitioned into the plating bath 12 and the agitation service bath 13. The larger bath is for the plating bath 12 and the smaller bath is for the agitation service bath 13. The plating liquid L overflowing from the plating bath 12 flows down to the agitation service bath 13 over the partition plate 11 (see FIG. 5 and FIG. 6).

Figure 3:
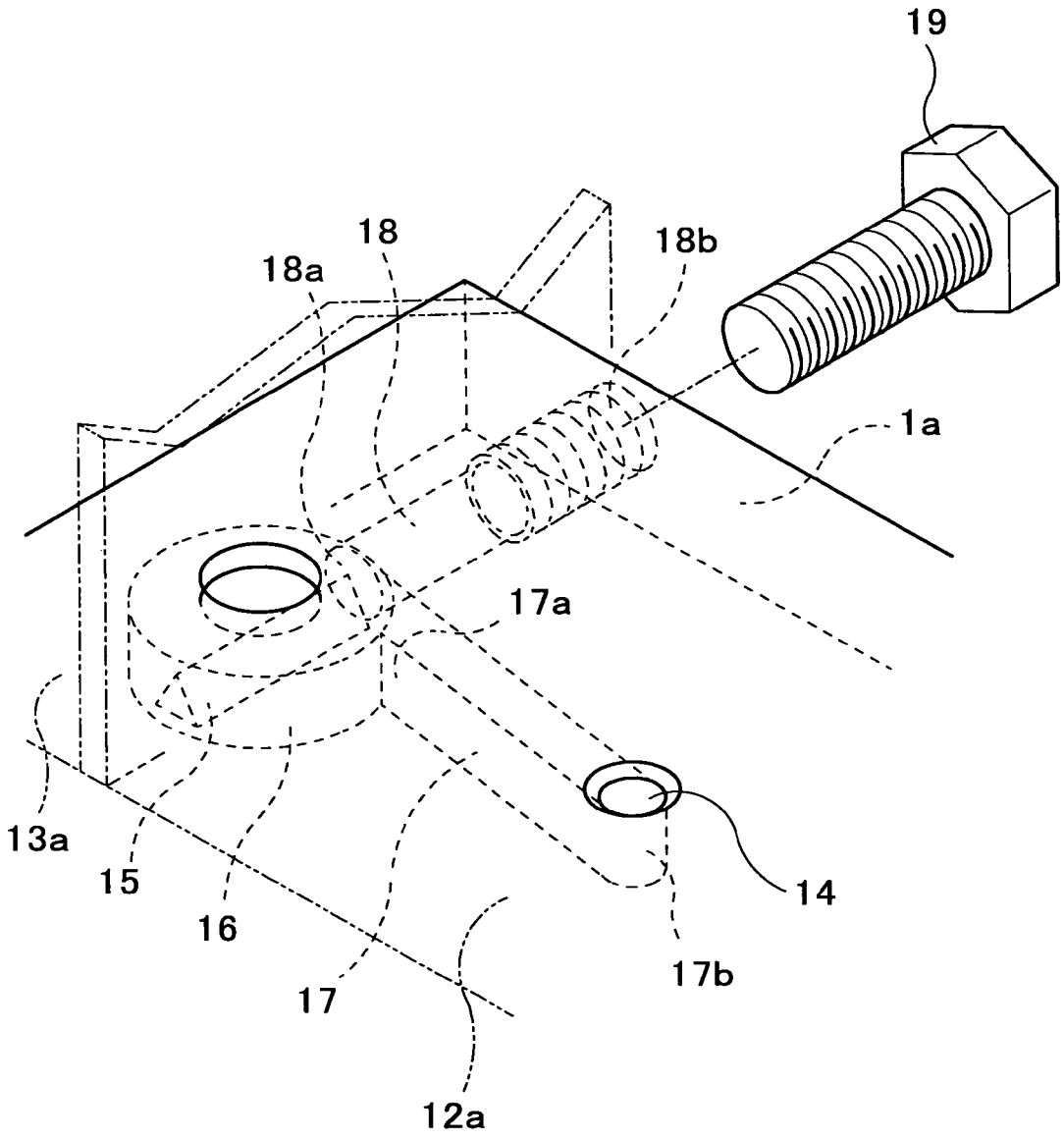
FIG. 3 is a drawing that shows a zoom-up view of the bottom of the plating tank.

FIG. 3 shows a zoom up view of the bottom portion of the plating tank 1. At the bottom portion 12*a* of the plating bath 12, a liquid supply outlet 14 is formed. The agitation room 16 and a maintenance service hole 18 are formed under the bottom portion 13*a* of the agitation service bath 13. A liquid supply tunnel which makes a path from the agitation room 16 to the liquid supply outlet 14 is formed under the bottom portion 12*a* of the plating bath 12.

The plating liquid L is supplied to the plating bath 12 through out the liquid supply outlet 14. The quantities and the shapes of the liquid supply outlet 14 can be changed on necessity. Besides the construction of the present invention, it is possible to form the liquid supply outlet 14 on the inner surface of the plating bath 12.

Figure 11:
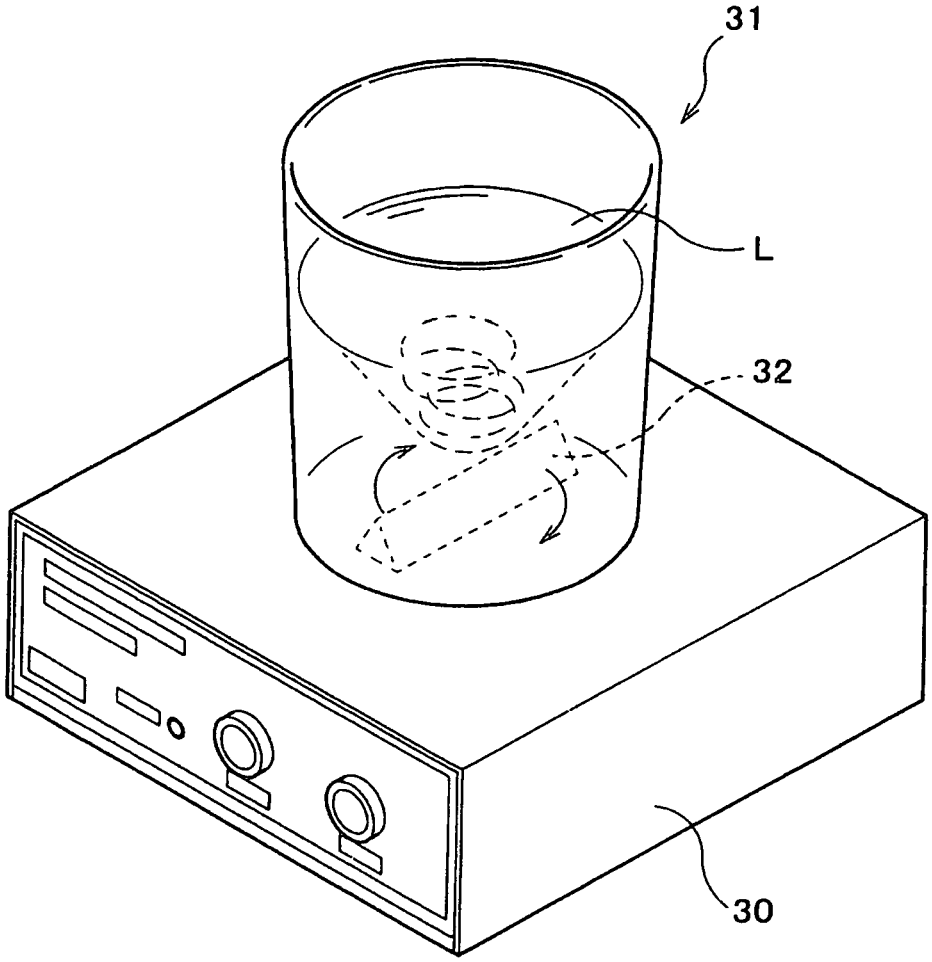
FIG. 11 is a drawing that shows a conventional technology to stir the plating liquid.
Figure 12:
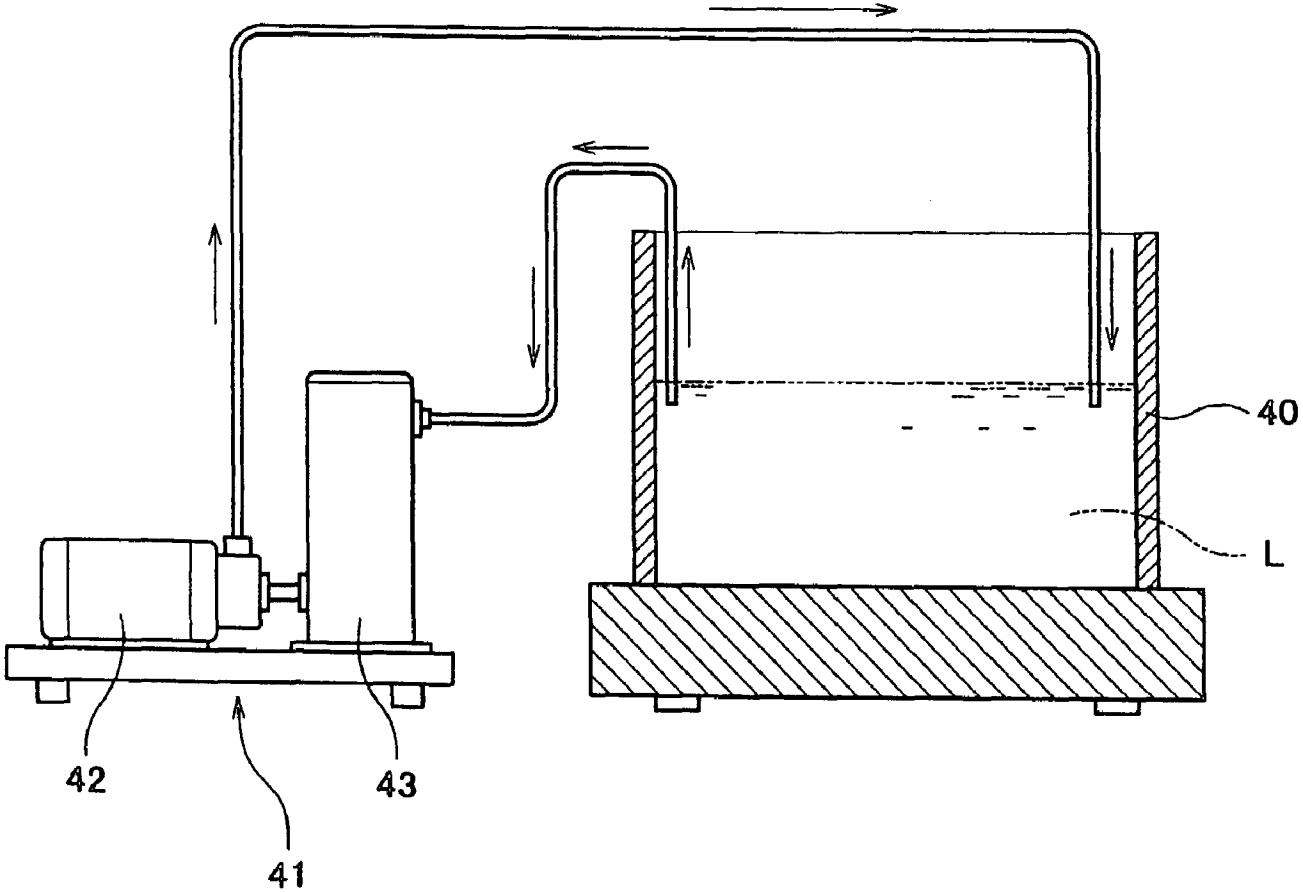
FIG. 12 is a drawing that shows a conventional plating apparatus with a circulation system.

An agitation rod 15 is formed in a triangle column shape which stays horizontally in the agitation room 16. The agitation rod 15 (which has the same function as the rotator 32 of the present technology as shown in FIG. 11) is horizontally rotated by an agitator station 2. The plating liquid L which stays in the agitation service bath 13 is agitated by the agitator rod 15 and the plating liquid L is sent to the liquid supply tunnel 17 by the centrifugal force. In this embodiment, a triangle column is adopted for the agitation rod 15 but other shape such as a circular column and standing circular plate is usable.

The agitation room 16 is formed in a shape of a cylindrical room and the agitation rod 15 can freely rotates when the plating tank 1 is set an appropriate place of agitator station 2. The rotation center of the agitation rod 15 roughly meets the open facing to the agitation service bath 13. When the agitation rod 15 starts to rotate, the plating liquid L in the agitation service bath 13 is agitated as well as the plating liquid L in the agitation service bath 13 comes down into the agitation room 16. The plating liquid L that comes into the agitation room 16 is sent to the liquid supply tunnel 17 by the rotation of the agitation rod 15.

Since the liquid supply tunnel 17 is opened at the liquid supply outlet 14, the plating liquid L sent by the agitation rod 15 comes out from the liquid supply outlet 14 and is supplied to the plating bath 12.

As shown in FIG. 13, the maintenance service hole 18 has an open hole to the agitation room 16 at one end 18*a* and the other open hole to the side wall 1*a* of the base of the plating tank 1 at the other end 18*b*. The maintenance service hole 18 allows the agitation rod 15 to be taken out or put back for the purpose of maintenance or inspection and works as a drain to discharge the plating liquid L staying both in the plating bath 12 and the agitation service bath 13.

At the other end 18*b* of the maintenance service hole 18, a bolt 19 is screwed in. For this construction of the maintenance service hole 18, the inner surface of the hole has a screwed groove to fit the bolt 19 in. Once the bolt 19 is tightly screwed into the other end 18*b* of the maintenance service hole 18, then the maintenance service hole 18 is shut off not to drain or leak the plating liquid L. Alternative screw bolt may be used to shut off the other end 18*b* of the maintenance service hole 18.

Figure 4:
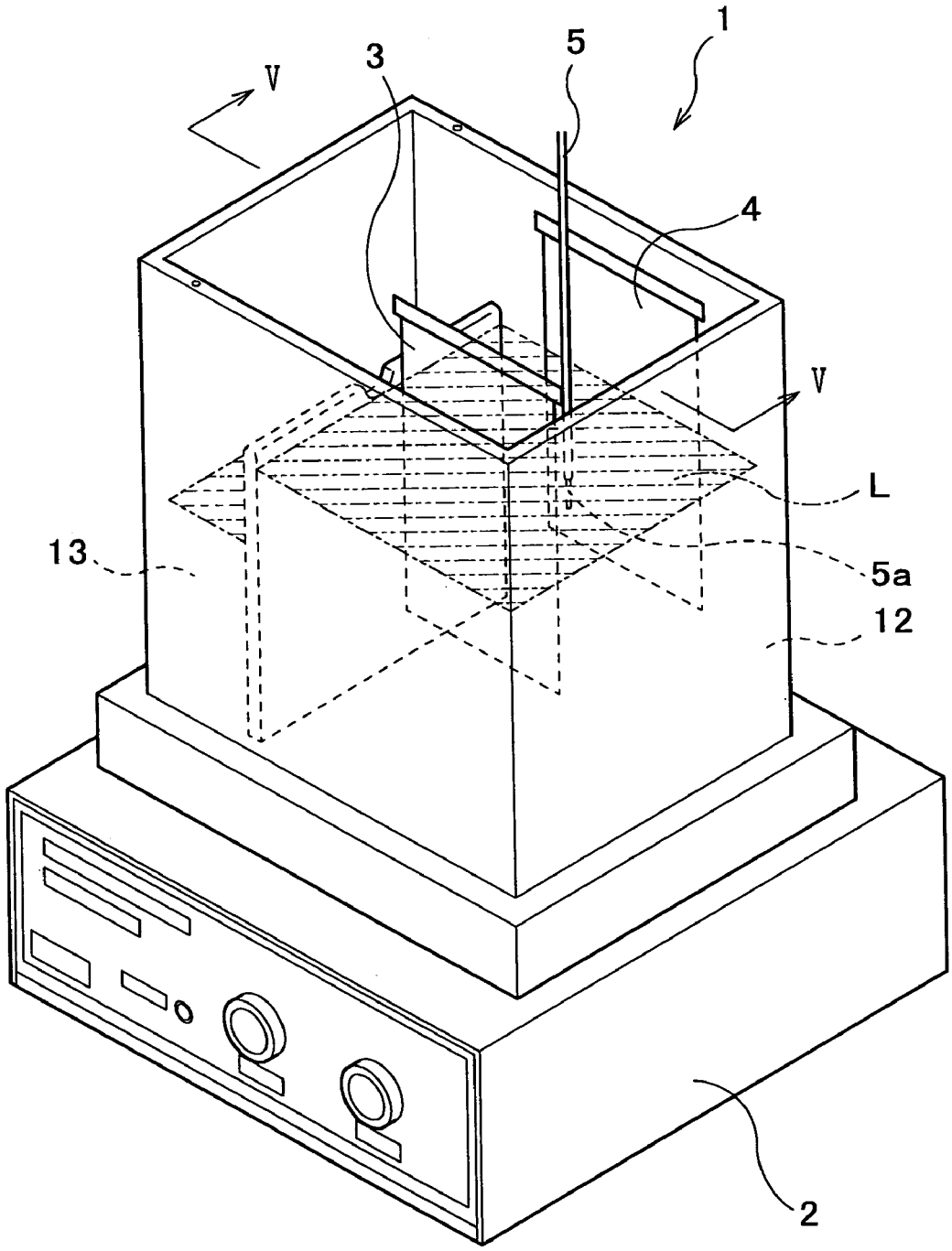
FIG. 4 is a perspective drawing of the plating tank for the use of electroplating.
Figure 5:
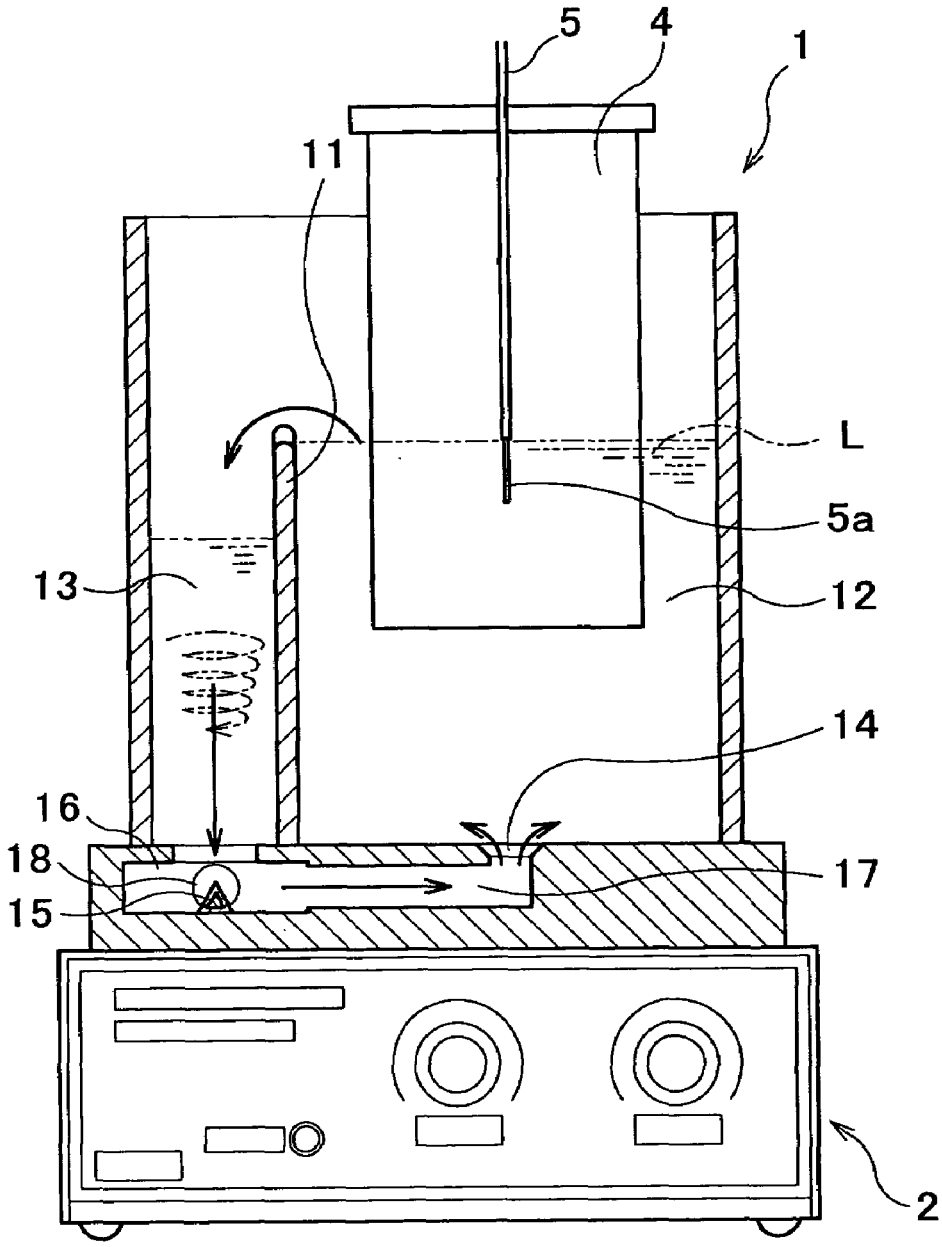
FIG. 5 is a cross sectional drawing cut in the line V-V in FIG. 4.
Figure 6:
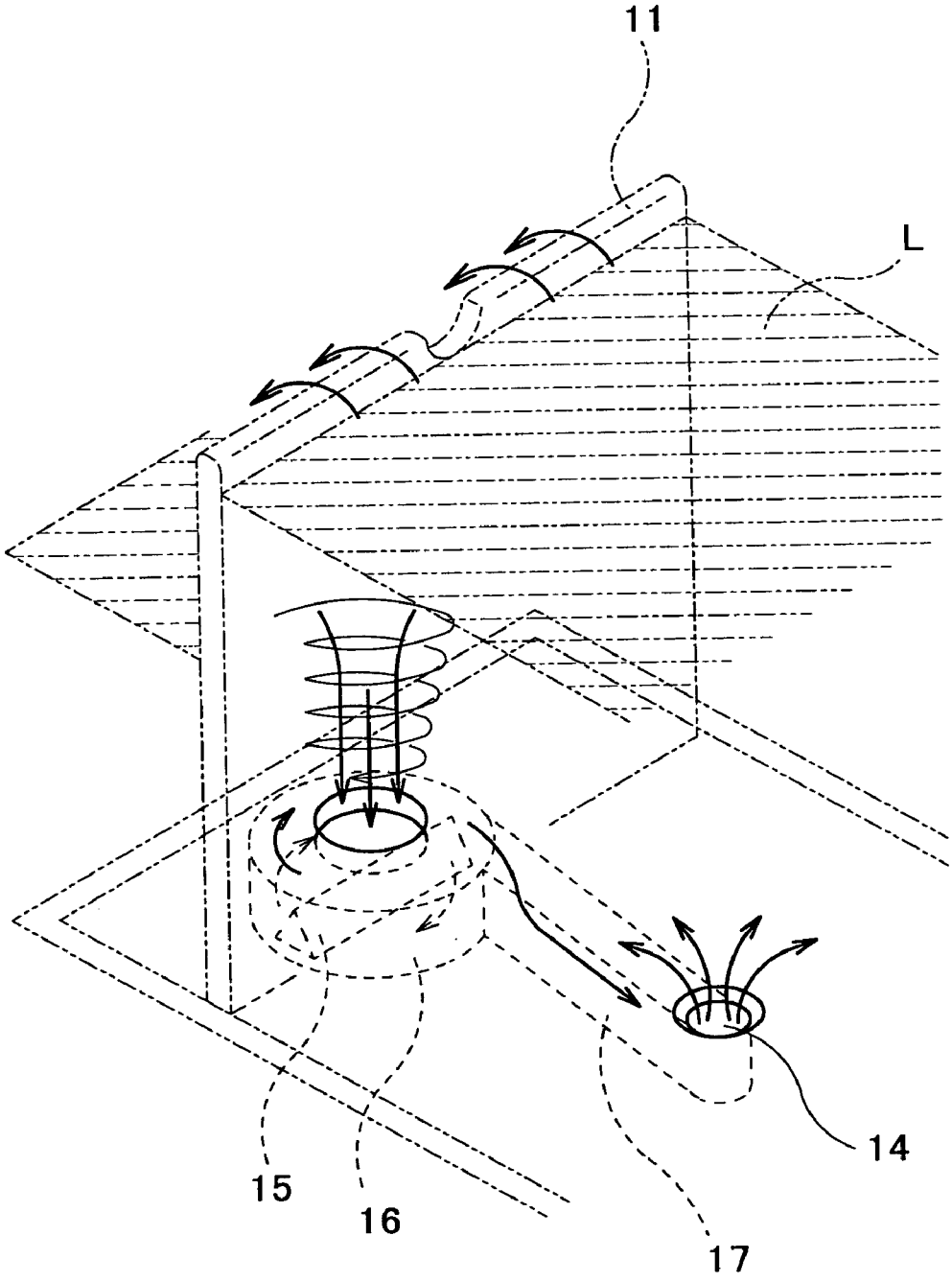
FIG. 6 is a perspective drawing that shows a zoom-up view of the bottom of the plating tank.

The operation of the plating tank 1 of the present invention is explained with the reference as the FIGS. 4 to 6. In the present embodiment, the plating tank 1 is used for the electroplating. FIG. 4 shows a perspective view of the plating tank 1. FIG. 5 shows the cut view taken along the line V-V of FIG. 4. FIG. 6 shows the flow of the plaiting liquid L at the portion of the bottom of the plating bath 12.

In order to drive the agitation rod 15, the plating tank 1 is set on the agitator station 2 that drives the agitation rod 15 by a magnetic force or an induced magnetism. The plating liquid L such as copper, nickel, or other metal iodide electrolytic solutions are supplied to the plating bath 12 and the agitation service bath 13. The plating liquid L is supplied in such an amount that the level of the plating liquid L in the plating bath 12 is flowing over the partition plate 11 to the agitation service bath 13 when the agitation rod 15 rotates.

In the plating bath 12, anodic plates 3 and 4 are set facing each other. These anodic plates 3 and 4 are thin metal plates made of cupper or nickel as depending on the metal plating kind to be plated and are suspended by protectors (not shown in the figures). These anodic plates are aligned in right angle to the partition plate 11 to be compliant to the flow of the plating liquid L so that they do not make disturbance in the flow, which results in a homogeneity in plating.

By holding with a suspending tool (not shown in the figures), the material 5 to be plated is immersed in the plating liquid L between the two anodic plates 3 and 4. In this embodiment, it is considered that the plating is done on the surface of the other end 5*a* of the material 5 to be plated. The material to be plated is electrically connected to the cathode of a DC power supply.

During the plating operation, the anodic plates 3 and 4 are electrically connected to the anode of the DC power supply. In this plating operation, the plating liquid L is agitated by the agitation rod 15 which rotates in the agitation room 16. The plating liquid L which comes into the agitation room 16 is sent to the liquid supply tunnel 17 by the rotation of the agitation rod 15.

The plating liquid L sent to the liquid supply tunnel 17 comes out to the plating bath 12 through the liquid supply outlet 14. By this supply system, the level of liquid surface of the plating liquid L in the plating bath 12 rises and the plating liquid L overflows on the top of the partition plate 11. And then the plating liquid L goes to the agitation service bath 13.

The plating liquid L which comes into the agitation service bath 13 is agitated therein and then sent to the liquid supply tunnel 17 again. The plating liquid L is circulated in this flow processes described above.

As have been explaining, no agitation is carried out in the plating bath 12 since the agitation is done in the agitation service bath 13. No rotational flow is generated in the plating bath 12. However, it is possible that the solution density and the temperature distribution of the plating liquid L can be homogenized in a shorter time than in the conventional technology since the agitation service bath 13 locates aside the plating bath 12 and has a simple open room shape. In the plating operation by using this plating tank 1, homogeneous plated surface is obtained and the height level of the plating liquid L can be kept constant.

This plating tank 1 has a circulation capability and the homogeneous plating liquid L in terms of the density and the temperature is always supplied to the plating bath 12. Therefore no additional circulation apparatus is required, which serves for small and compact assembly of overall plating apparatus and no overhead of the plating liquid L is required.

Figure 7:
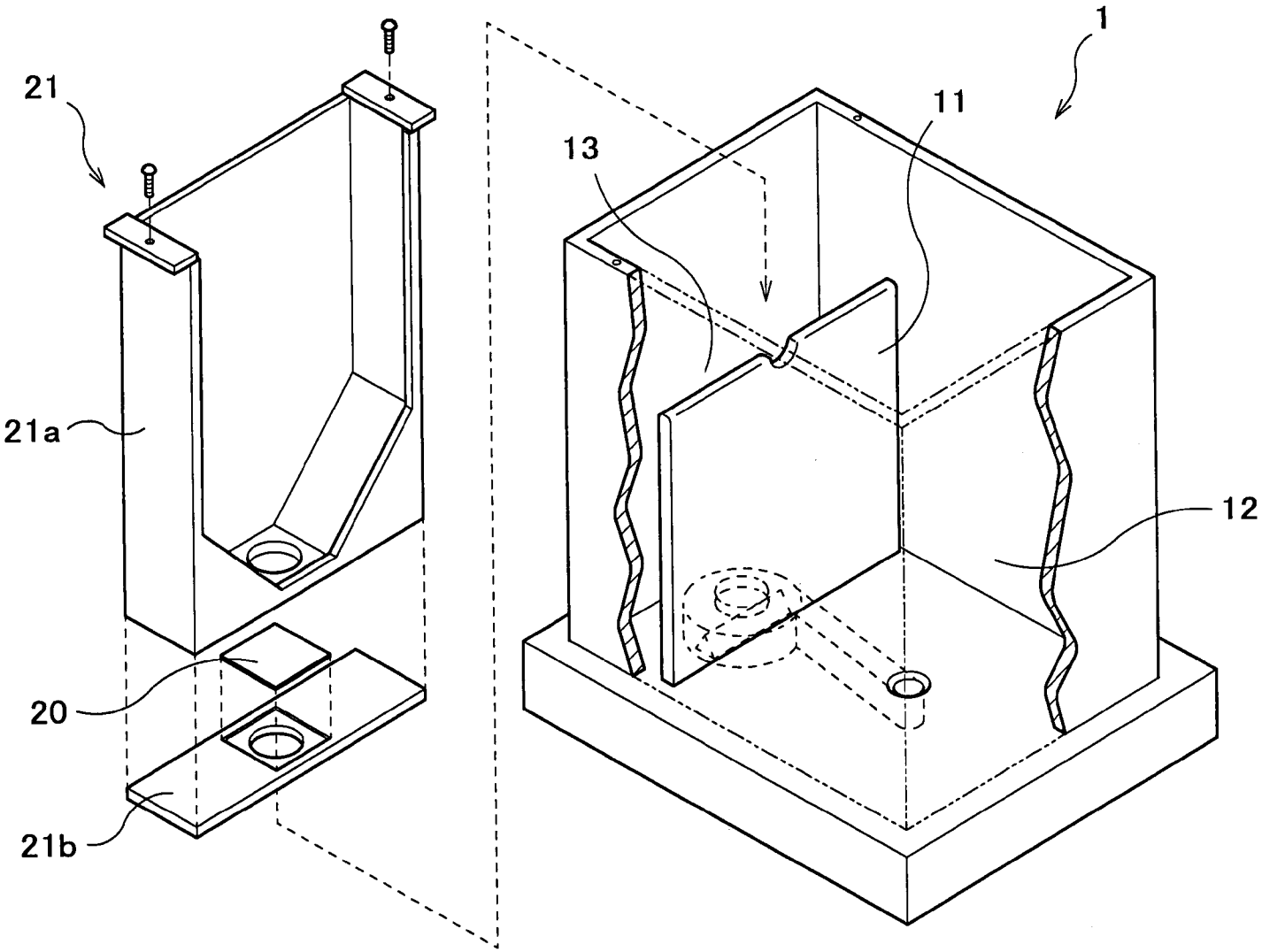
FIG. 7 is a perspective drawing that shows the assembly of a filter holder that holds a filter.
Figure 8:
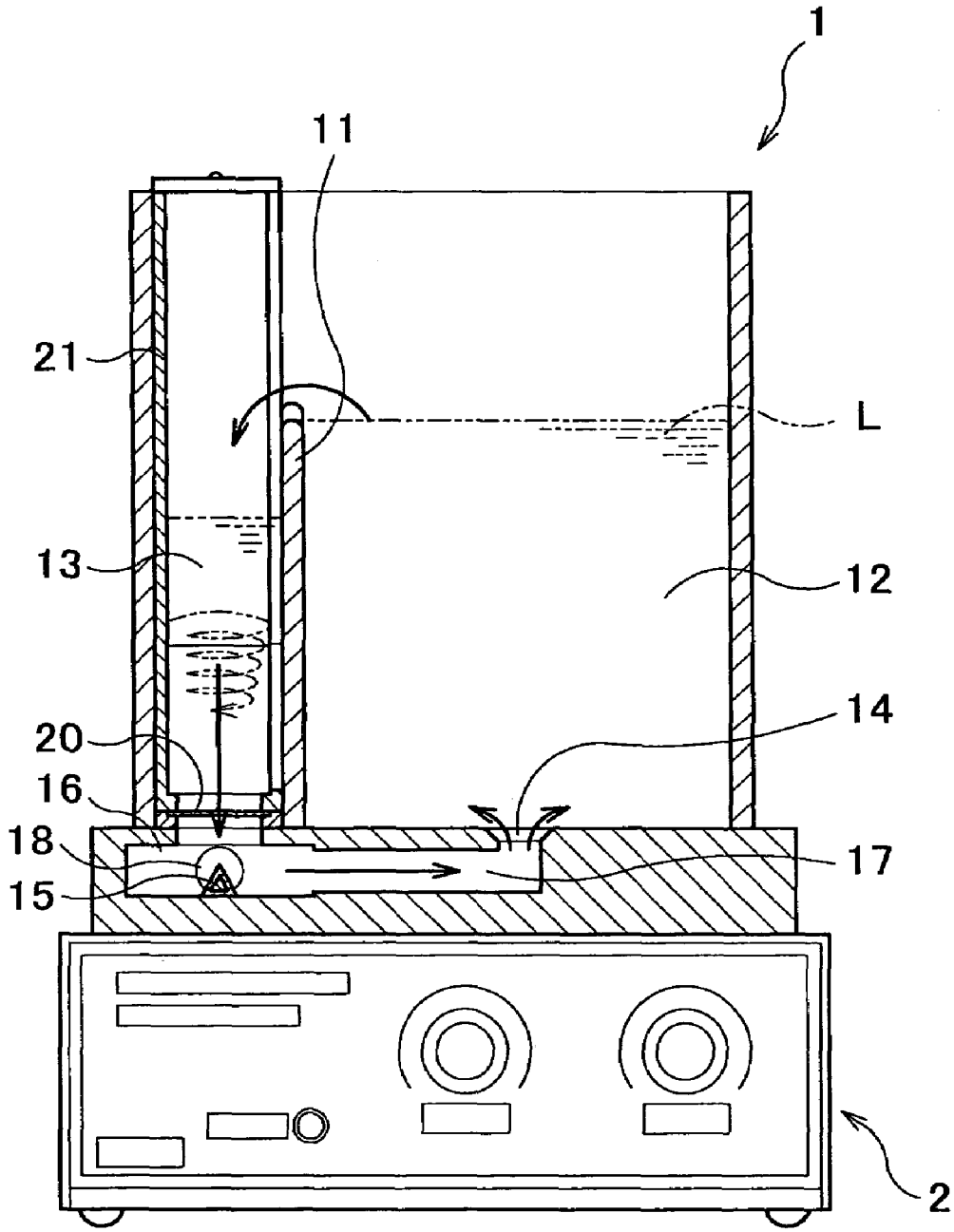
FIG. 8 is a cross sectional drawing that shows the installation of the filter holder in the agitation service bath.

Another embodiment of the present invention is shown in FIGS. 7 and 8 where a filter 20 to filtrate the plating liquid L during agitation is installed.

FIG. 7 shows a perspective view of the filter 20 and the filter holder 21. The filter 20 is held in the filter holder 21 which has a similar shape as the inner room of the agitation service bath 13 and fits thereto. The filter holder 21 is formed in an assembly of an upper part 21*a* and a lower part 21*b*. The filter 20 is held between the upper part 21*a* and the lower part 21*b*. The filter 20 is set in every filter holder 21. The filter holder 21 is installed into the agitation service bath 13 by screws 21.

FIG. 8 shows the primary portion of the plating tank 1 with the filter holder 21. The figure corresponds to FIG. 2. The filter 20 being set on the upper portion of the agitation room 16 but still in the agitation service bath 13 filtrates the plating liquid L coming into the agitation room 16 from the agitation service bath 13 and therefore only the filtrated plating liquid is supplied to the plating bath 12.

Figure 9:
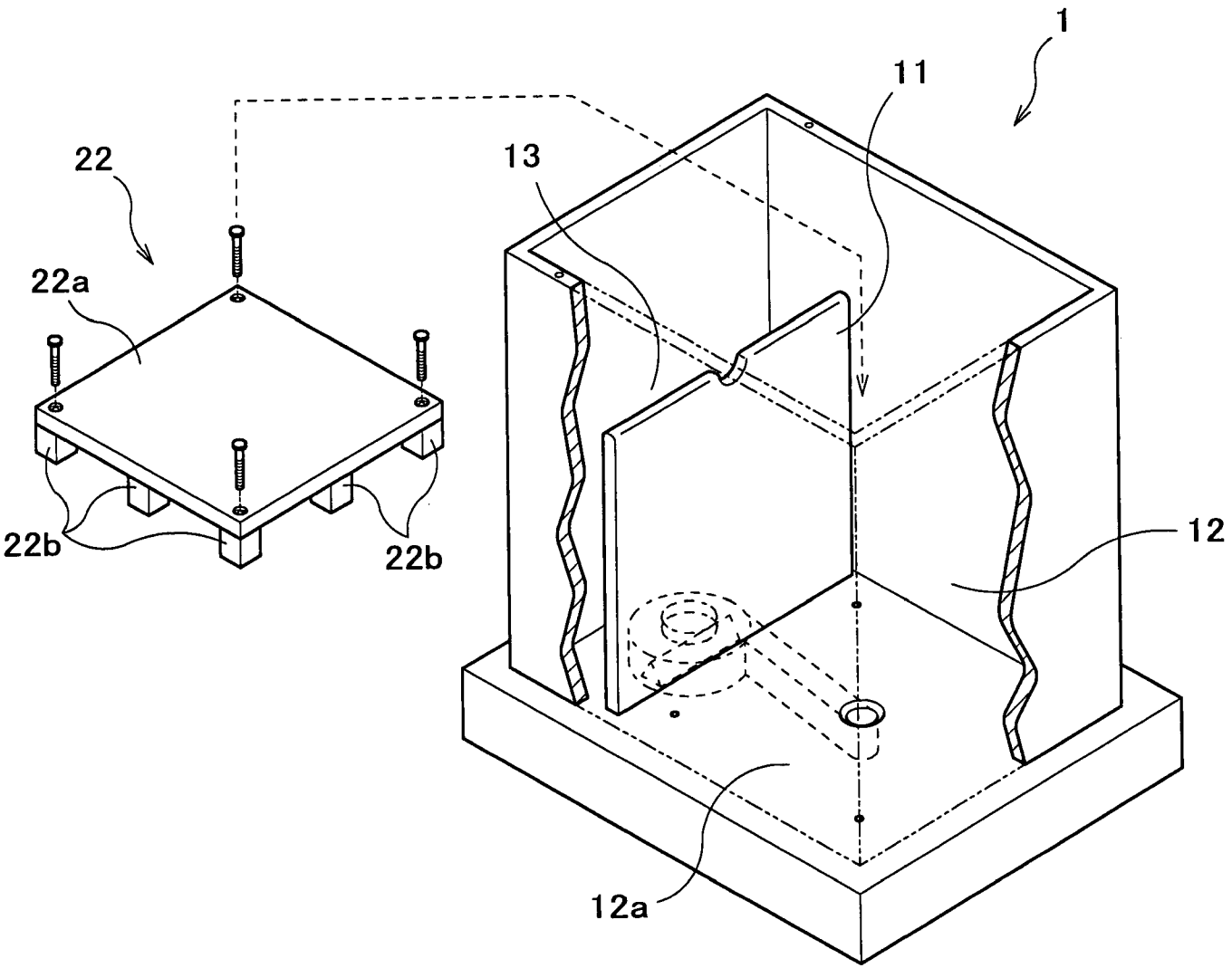
FIG. 9 is a perspective drawing that shows a baffle.
Figure 10:
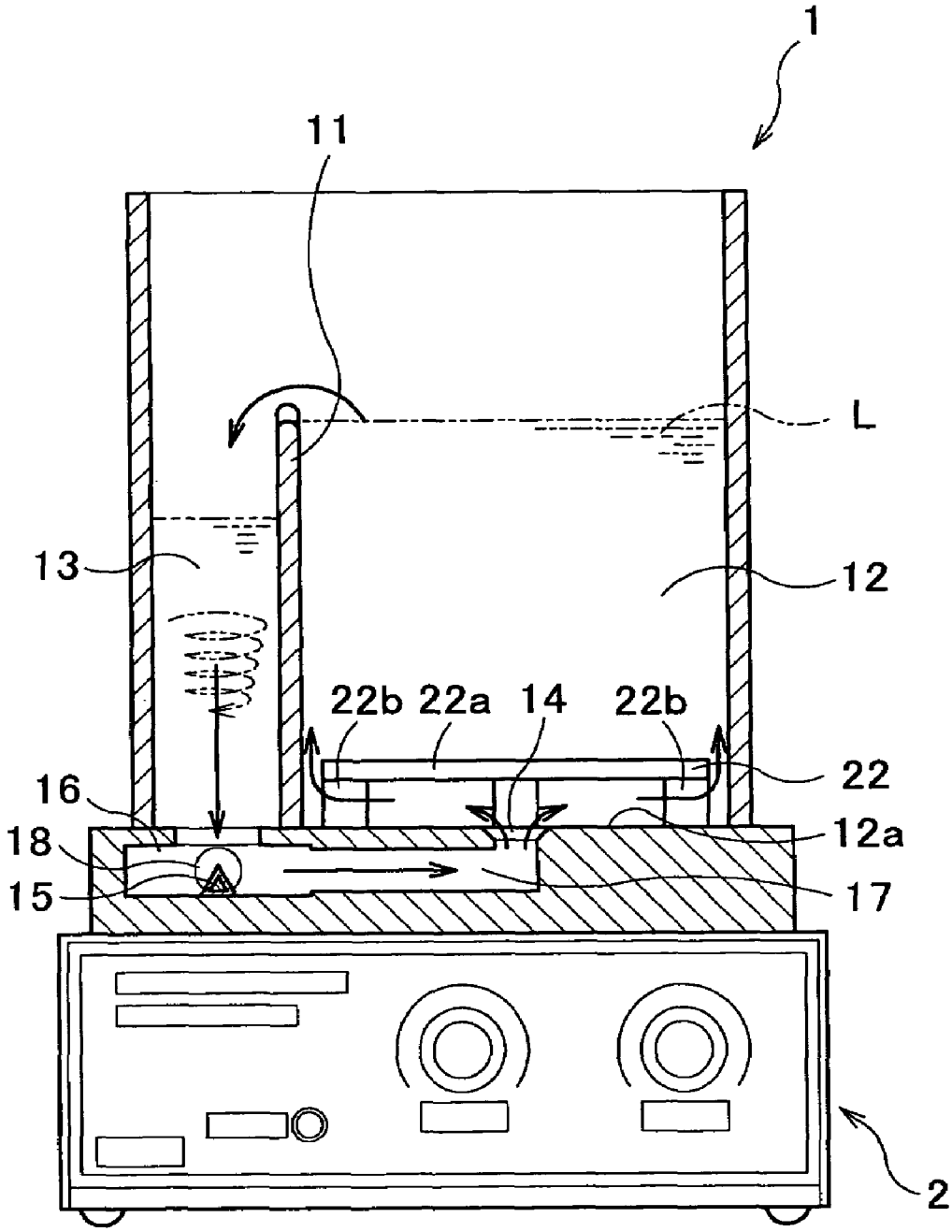
FIG. 10 is an installation drawing that shows the baffle set onto the bottom of the plating bath.

FIG. 9 and FIG. 10 show the installation of the baffle 22 so that the plating liquid L coming out from the liquid supply outlet 14 does not directly bump to the material to be plated as well as the anodic plates 3 and 4.

FIG. 9 shows a perspective view showing the installation of the baffle 22. The baffle 22 composes of a baffle plate 22*a* and spacers 22*b*. The baffle 22 is fixed to the bottom of the plating bath 12 by screws.

Figure 2:
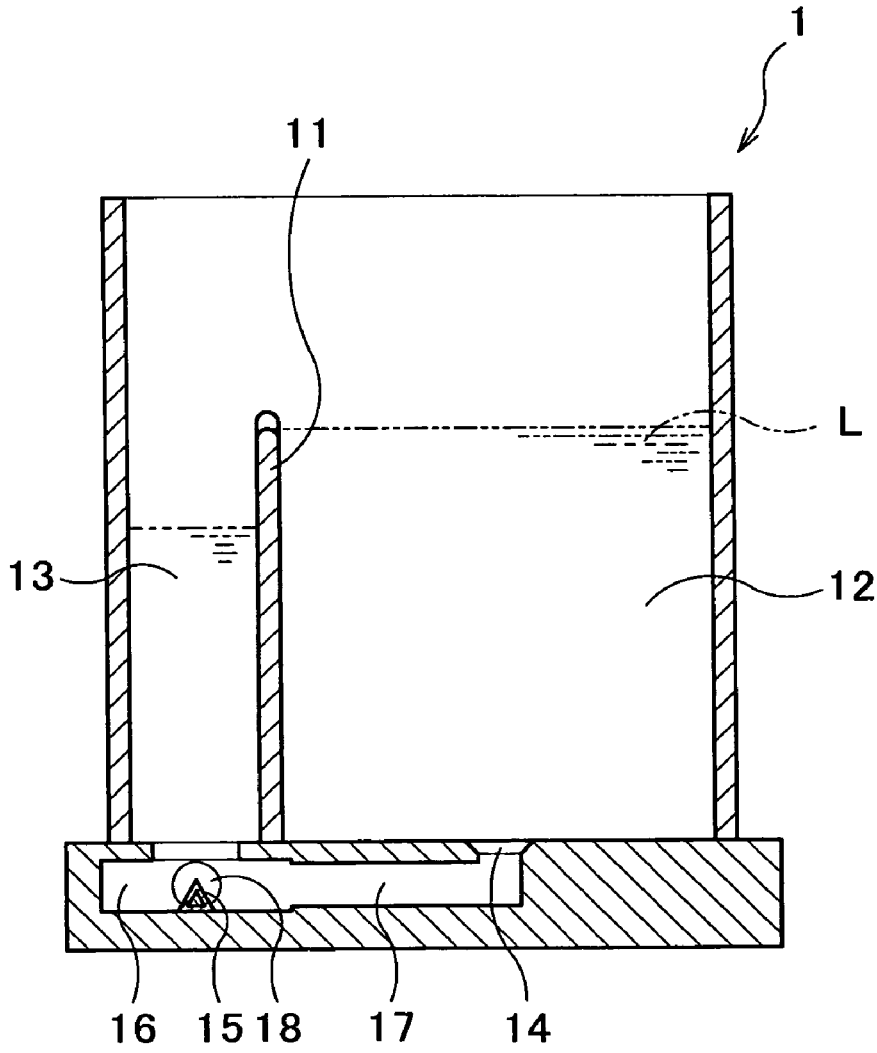
FIG. 2 is a cross sectional drawing cut in the line II-II in FIG. 1.

FIG. 10, being corresponding to FIG. 2, shows a cross sectional view showing the installation of the baffle 22. The baffle plate 22*a* is lifted off from the liquid supply outlet 14 by the spacers 14*b*. The plating liquid L which comes out from the liquid supply outlet 14 bumps against the baffle plate 22*a* and the flow direction thereof changes so that the plating liquid L flows through out the gaps between the baffle plate 22*a* and the inner space of the plating bath 12.

The cross sectional area against the flow formed by such gaps is larger than the area of the liquid supply outlet 14 against the flow. Therefore the flow of the plating liquid L is gentle and does not straightly go to the material to be plated. In addition, it is possible to design the flow of the plating liquid L in the plating bath 12 to be compliant to the predetermined flow shape or traveling by making holes or slits in the baffle plate 22*a*.

Although there have been disclosed what are the patent embodiment of the invention, it will be understood by a person skilled in the art that variations and modifications may be made thereto without departing from the scope of the invention, which is indicated by the appended claims.

For example, the above embodiments relate to an application to be used for an electroplating tank 1 but the present invention is applicable to an electroless plating tank as well. The present invention has a further advantage for the use of the liquid control application other than plating such as applications to a submerged culture apparatus, a biochemical flask, a saturation solvent mixer, etc.

As has been explaining, the present invention provides a plating tank which enables to keep the homogeneity in the density and the temperature distribution of the liquid for wet plating. A further advantage of the present invention is that the rotational flow generated by the agitation to the plating liquid L is suppressed and therefore stripe patters on the plated surface of the plated material is hardly made thereby providing good plating quality. The present invention has another further advantage that an external circulator system such as an electric pump and a filter is not necessary, so that the whole system can be realized in a compact physical size.

What is claimed is:

1. A liquid tank, comprising:

a process bath;

an agitation service bath assembly comprising an agitation service bath, the process bath and the agitation service bath being separated by a partition plate over which process liquid staying in said process bath flows out to said agitation service bath, the agitation service bath assembly, further comprising an agitation room arranged under a bottom portion of said agitation service bath, wherein the process liquid from the agitation service bath flows into the agitation room, said process liquid in said agitation service bath is agitated by an agitation means provided in said agitation room;

a liquid supply tunnel through which said process liquid goes from said agitation room to said process bath; and a liquid supply outlet located at an end of said liquid supply tunnel and opens to said process bath at a bottom portion of said process bath, wherein the agitation room comprises an agitation rod and wherein the agitation rod is shaped like a column having a side laid on a bottom of the agitation room and configured to rotate horizontally, thereby supplying the process liquid through the liquid supply tunnel into the process bath which raises a level of a liquid surface of the process liquid in the process bath and causes the process liquid in the process bath to flow out over the partition plate to the agitation service bath.

2. A liquid tank according to claim 1, wherein said agitation rod which is magnetically rotated by an agitator station on which said liquid tank is set.

3. A liquid tank according to claim 2, wherein said process liquid is plating liquid by which plating is carried out onto a material to be plated in said process bath.

4. A liquid tank according to claim 1, wherein a filter is installed in said agitation service bath.

5. A liquid tank according to claim 4, wherein said process liquid is plating liquid by which plating is carried out onto a material to be plated in said process bath.

6. A liquid tank according to claim 4, wherein said filter is held in a filter holder which is installed in said agitation service bath.

7. A liquid tank according to claim 6, wherein said filter holder is formed in an assembly of an upper part and a lower part between which said filter is held.

8. A liquid tank according to claim 6, wherein said process liquid is plating liquid by which plating is carried out onto a material to be plated in said process bath.

9. A liquid tank according to claim 7, wherein said process liquid is plating liquid by which plating is carried out onto a material to be plated in said process bath.

10. A liquid tank according to claim 1, wherein a baffle is installed in said process bath.

11. A liquid tank according to claim 10, wherein said process liquid is plating liquid by which plating is carried out onto a material to be plated in said process bath.

12. A liquid tank according to claim 10, wherein said baffle comprises a baffle plate and a set of spacers against said bottom portion of said process bath.

13. A liquid tank according to claim 12, wherein said process liquid is plating liquid by which plating is carried out onto a material to be plated in said process bath.

14. A liquid tank according to claim 1, wherein said process liquid is plating liquid by which plating is carried out onto a material to be plated in said process bath.

15. The liquid tank according to claim 1, wherein the agitation room is formed in a shape of a cylindrical room within the agitation service bath assembly.

16. A liquid tank comprising:

a process bath;

an agitation service bath, the process bath and the agitation service bath being separated by a partition plate, wherein process liquid staying in the process bath is allowed during agitation to flow out over a top edge of the partition plate to the agitation service bath;

an agitation means configured to cause agitation of the process liquid in the agitation service bath and to force the process liquid from the agitation service bath to the process bath through a liquid supply tunnel at the end of which a liquid supply outlet is provided which opens to the process bath, at a bottom portion of the process bath, such that the process liquid is supplied from the bottom portion into the process bath, wherein the agitation means comprises an agitation room provided under a bottom portion of the agitation service bath and an agitation rod provided in the agitation room, and wherein the agitation rod is shaped like a column having a side laid on a bottom of the agitation room and configured to rotate horizontally, thereby supplying the process liquid through the liquid supply tunnel into the process bath which raises a level of a liquid surface of the process liquid in the process bath and causes the process liquid in the process bath to flow out over the partition plate to the agitation service bath.

17. The liquid tank according to claim 16, wherein the agitation room has a cylindrical hollow space to permit horizontal rotation of the agitation rod therein, and another end of the liquid supply tunnel is in fluid communication with the agitation room at a cylindrical side wall thereof.

* * * * *